US011366420B2

(12) United States Patent
Ishii et al.

(10) Patent No.: US 11,366,420 B2
(45) Date of Patent: Jun. 21, 2022

(54) LUBRICANT APPLICATOR TO COUNTERACT BRISTLE-BENDING

(71) Applicant: Hewlett-Packard Development Company, L.P., Spring, TX (US)

(72) Inventors: Yasuyuki Ishii, Yokohama (JP); Katsushi Higashida, Yokohama (JP); Koichiro Takashima, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/274,515

(22) PCT Filed: May 22, 2019

(86) PCT No.: PCT/US2019/033528
§ 371 (c)(1),
(2) Date: Mar. 9, 2021

(87) PCT Pub. No.: WO2020/076368
PCT Pub. Date: Apr. 16, 2020

(65) Prior Publication Data

US 2021/0341872 A1 Nov. 4, 2021

(30) Foreign Application Priority Data

Oct. 12, 2018 (JP) ..... JP2018-193359

(51) Int. Cl.
*G03G 21/00* (2006.01)

(52) U.S. Cl.
CPC ..... *G03G 21/0094* (2013.01); *G03G 21/0011* (2013.01); *G03G 21/0035* (2013.01); *G03G 2221/0084* (2013.01)

(58) Field of Classification Search
CPC ..... G03G 21/0094
USPC ..... 399/346
See application file for complete search history.

(56) References Cited

U.S. PATENT DOCUMENTS

| | | | | |
|---|---|---|---|---|
| 8,235,177 | B2 * | 8/2012 | Kawahara et al. | G03G 21/0005 399/346 |
| 8,712,261 | B2 * | 4/2014 | Kudo et al. | G03G 21/0094 399/346 |
| 9,841,718 | B2 * | 12/2017 | Ogura et al. | G03G 21/0094 |
| 9,897,966 | B2 | 2/2018 | Haga | |
| 9,927,762 | B2 | 3/2018 | Dixon et al. | |
| 2005/0153558 | A1 | 7/2005 | Koh et al. | |
| 2008/0013978 | A1 | 1/2008 | Facci et al. | |

(Continued)

FOREIGN PATENT DOCUMENTS

JP 2012-189697 A 10/2012

*Primary Examiner* — William J Royer
(74) *Attorney, Agent, or Firm* — Jefferson IP Law, LLP

(57) ABSTRACT

A lubricant application device includes an application roller with application bristles radially arranged about an outer circumferential surface thereof for receiving a lubricant from a lubricant supply source and applying the lubricant to a photosensitive body. A minimum distance between the outer circumferential surface of the application roller and the photosensitive body is shorter than a length of the application bristles. The lubricant application device has a drive unit for rotating the application roller and a controller for controlling the drive unit. The controller is adapted to control the drive unit to counteract a bristle-bending tendency of the application bristles.

13 Claims, 11 Drawing Sheets

(56) References Cited

U.S. PATENT DOCUMENTS

| | | | |
|---|---|---|---|
| 2009/0052948 | A1 | 2/2009 | Ozerov |
| 2011/0129247 | A1 | 6/2011 | Soures et al. |
| 2013/0343793 | A1 | 12/2013 | Nishisaka et al. |
| 2015/0153704 | A1 | 6/2015 | Nishisaka |
| 2016/0179036 | A1 | 6/2016 | Deprez et al. |
| 2017/0160696 | A1 | 6/2017 | Ogura et al. |
| 2017/0336750 | A1 | 11/2017 | Haga |

* cited by examiner

LUBRICANT APPLICATOR TO COUNTERACT BRISTLE-BENDING

BACKGROUND

In some image forming apparatuses such as printers and multifunctional machines, the entire surface of a photosensitive body is uniformly charged by a charging device at the time of an image forming operation. Light is irradiated to the uniformly charged surface of the photosensitive body by an exposure device to form an electrostatic latent image of print data. Toner is adsorbed to the electrostatic latent image for development thereof by a developing device. A developed toner image on the photosensitive body is primarily transferred to a transfer belt, and the toner image on the transfer belt is secondarily transferred to paper. The secondarily transferred toner image on the paper is fused on the paper by a fixing device, and the paper is discharged to a paper tray or the like.

Some of these image forming apparatuses are provided with a lubricant application device for applying a lubricant to the surface of the photosensitive body. Some of the lubricant application devices have an application roller provided with application bristles about an outer circumferential surface thereof. The application roller is rotated by a motor, and receives a lubricant from a lubricant supply source and applies the lubricant to the photosensitive body. The application bristles of the application roller may be in constant abutment with the photosensitive body.

DETAILED DESCRIPTION

Figure 1:
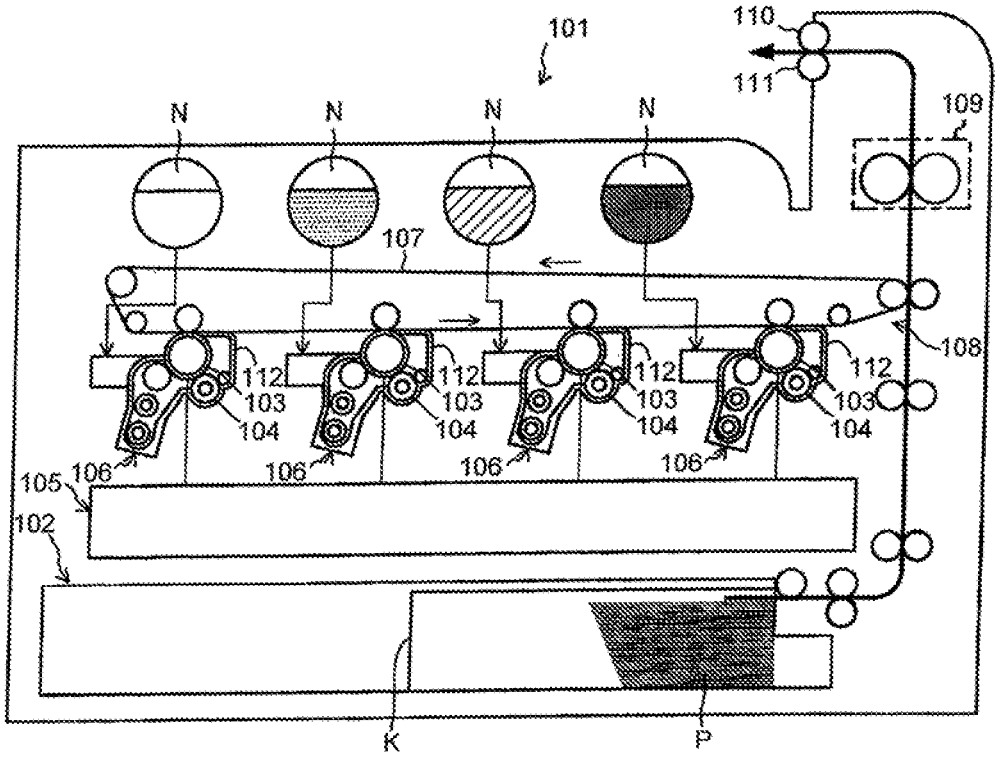
FIG. 1 is a schematic diagram showing an example imaging apparatus.

An example lubricant application device is for applying a lubricant to a photosensitive body in an imaging apparatus. The example lubricant application device may include: a lubricant supply source; an application roller; a drive unit for rotating the application roller; and a controller for controlling the drive unit. The application roller may have application bristles radially arranged about an outer circumferential surface thereof for receiving the lubricant from the lubricant supply source and for applying the lubricant to the photosensitive body. The application roller may be positioned relative to the photosensitive body such that a minimum distance between the outer circumferential surface of the application roller and the photosensitive body is shorter than an entire length of the application bristles. The controller may control the drive unit, so that the drive unit rotates the application roller according to a rotation that counteracts a bristle-bending tendency of the application bristles of the application roller due to an abutment between the application bristles and the photosensitive body. For example, the controller may be adapted to control the drive unit so as to rotate the application roller in a forward and/or reverse direction to prevent the application bristles of the application roller from having a bristle-bending tendency (or bristle-bending habit) due to abutment between the application bristles and the photosensitive body, and/or to recover the application bristles from a bristle-bending tendency (or bristle-bending habit) caused by the abutment.

In an example lubricant application device, the control of the drive unit by the controller may include repeatedly rotating the application roller at predetermined time intervals during which no bristle-bending tendency is developed due to the abutment between the application bristles of the application roller and the photosensitive body.

In an example lubricant application device, the control of the drive unit by the controller may include, before an imaging operation, rotating the application roller at least by 360° in such a direction that portions of the application bristles of the application roller having a bristle-bending tendency are restored by the abutment between the application bristles and the photosensitive body.

In an example lubricant application device, there may be provided a plate-like application bristle restoration member having a long side (e.g. a lengthwise side) having a length at least equal to an entire length of the application roller along an axial direction of the application roller. The application bristle restoration member may be arranged such that the long side is disposed at a position separated from the outer circumferential surface of the application roller by a predetermined distance shorter than the entire length of the application bristles along a radial direction of the application roller. The control of the drive unit by the controller may include, before an imaging operation, rotating the application roller such that portions of the application bristles of the application roller having a bristle-bending tendency pass through the application bristle restoration member at least once, and the rotation is made in such a direction that the portions of the application bristles having a bristle-bending tendency are restored by the abutment with the application bristle restoration member.

In an example lubricant application device, there may be provided a plate-like application bristle restoration member having a long side (or lengthwise side) with a length at least equal to an entire length of the application roller along an axial direction of the application roller. The application bristle restoration member may be arranged such that the long side is disposed at a position separated from the outer circumferential surface of the application roller by a predetermined distance shorter than the entire length of the application bristles along a radial direction of the application roller and is adapted to restore, at the time of a forward rotation of the application roller, portions of the application bristles bent in a first direction. The control of the drive unit by the controller may include: stopping the rotation of the application roller after an imaging operation, whereby portions of the application bristles of the application roller abutting the photosensitive body are bent in a second direction opposite to the first direction; then, reverse-rotating the application roller until the portions of the application bristles abutting the photosensitive body are bent in the first direction; and restoring the portions of the application bristles of the application roller having a bristle-bending tendency through the application bristle restoration member during a succeeding imaging operation.

In an example lubricant application device, at the time of applying the lubricant to the photosensitive body, the photosensitive body and the application roller may both rotate, the application roller may rotate in a forward direction relative to the photosensitive body, and the application bristles of the application roller may have 0.5 to 1.5 times of moving speed of the photosensitive body.

In an example lubricant application device, the application bristles may be made of polyethylene terephthalate. The application bristles may have an entire length of 1 to 2 mm, a fiber diameter of 3 to 10 deniers and a fiber density of 78 to 465 per $mm^2$ (50 to 300 $KF/inch^2$). An amount of intrusion of the application bristles, which may correspond to a value obtained by subtracting a minimum distance between the outer circumferential surface of the application roller and the photosensitive body from the entire length of the application bristles, may be 0.3 to 1.3 mm. An amount of intrusion of the application bristle restoration member, that is a value obtained by subtracting, from the entire length of the application bristles, a distance from the outer circumferential surface of the application roller to the long side of the application bristle restoration member along the radial direction of the application roller, may be 0.3 to 1.3 mm.

In an example lubricant application device, the lubricant supply source may be formed of a molded body of a fatty acid metal salt.

An example cleaning device may include the lubricant application device.

An example imaging apparatus may include the cleaning device.

Also, an example method for preventing application bristles of an application roller from having a bristle-bending tendency and/or recovering application bristles of the application roller from a bristle-bending tendency may include: disposing a lubricant supply source; disposing an application roller having application bristles radially arranged about an outer circumferential surface thereof for receiving a lubricant from the lubricant supply source and applying the lubricant to a photosensitive body, wherein the application roller is positioned relative to the photosensitive body such that a minimum distance between the outer circumferential surface of the application roller and the photosensitive body is shorter than an entire length of the application bristles; disposing a drive unit for rotating the application roller; and disposing a controller for controlling the drive unit. The controller may be adapted to control the drive unit so as to rotate the application roller in a forward and/or reverse direction to prevent the application bristles of the application roller from having a bristle-bending tendency due to abutment between the application bristles and the photosensitive body, and/or to recover the application bristles from a bristle-bending tendency caused by the abutment.

In the example method, the controller may be adapted to control the drive unit so as to repeatedly rotate the application roller at predetermined time intervals during which no bristle-bending tendency is developed due to the abutment between the application bristles of the application roller and the photosensitive body.

In the example method, the controller may be adapted to control the drive unit so as to rotate the application roller at least by 360° in such a direction that portions of the application bristles of the application roller having a bristle-bending tendency are restored by abutment between the application bristles and the photosensitive body before an imaging operation.

The example method may further include disposing a plate-like application bristle restoration member having a long side (or lengthwise side) with a length at least equal to an entire length of the application roller along an axial direction of the application roller. The application bristle restoration member is arranged such that the long side is disposed at a position separated from the outer circumferential surface of the application roller by a predetermined distance shorter than the entire length of the application bristles along a radial direction of the application roller. The controller may be adapted to control the drive unit so as to, before an imaging operation, rotate the application roller such that portions of the application bristles of the application roller having a bristle-bending tendency pass through the application bristle restoration member at least once, and the rotation is made in such a direction that the portions of the application bristles having a bristle-bending tendency are restored by the abutment with the application bristle restoration member.

The example method may further include disposing a plate-like application bristle restoration member having a long side with a length at least equal to an entire length of the application roller along an axial direction of the application roller. The application bristle restoration member may be arranged such that the long side is disposed at a position separated from the outer circumferential surface of the application roller by a predetermined distance shorter than the entire length of the application bristles along a radial direction of the application roller, wherein the application bristles restoration member is adapted to restore, at the time of a forward rotation of the application roller, portions of the application bristles bent in a first direction. The controller may be adapted to control the drive unit so as to: stop the rotation of the application roller after an imaging operation, whereby portions of the application bristles of the application roller abutting the photosensitive body are bent in a second direction opposite to the first direction; and then, reverse-rotate the application roller until the portions of the application bristles abutting the photosensitive body are bent in the first direction, and thereby, the portions of the application bristles of the application roller having a bristle-bending tendency are restored through the application bristle restoration member during a succeeding imaging operation.

In the following description, with reference to the drawings, the same reference numbers are assigned to the same components or to similar components having the same function, and overlapping description is omitted. Identical or similar constituent elements in different drawings may be indicated in the figures by numerals having identical last two digits. For example, the first numeral of triple digits may indicate the number of the drawing (e.g. both of the sign 123 in FIG. 1 and the sign 223 in FIG. 2 (the same applies hereinafter) may indicate an identical or similar element).

FIG. 1 schematically shows an example imaging apparatus 101 capable of using an example lubricant application device. The imaging apparatus 101 is an apparatus that may form a color image by using respective toner cartridges N of magenta, yellow, cyan and black, for example. The imaging apparatus 101 may have: a cassette K holding paper P stacked therein; a recording medium conveyance device 102 for conveying the paper P; a charging roller 104 for uniformly charging a surface of a photosensitive body 103 at a predetermined electric potential; an exposure device 105 for forming an electrostatic latent image on the surface of the photosensitive body 103 charged by the charging roller 104; a developing device 106 for adsorbing toner supplied from the toner cartridges N to the electrostatic latent image on the photosensitive body 103 to develop the electrostatic latent image; a transfer device 108 for primarily transferring the toner image on the photosensitive body 103 to a transfer belt 107 and then secondarily transferring the toner image on the transfer belt 107 to the paper P conveyed by the recording medium conveyance device 102; a fixing device 109 for fusing the toner image secondarily transferred on the paper P onto the paper P; and discharge rollers 110, 111 for discharging the paper P having the toner image fixed by the fixing device 109 to the outside of the imaging apparatus 101. The imaging apparatus 101 may also have a cleaning device 112 for collecting toner remaining on the photosensitive body 103 after a primary transfer of the toner image onto the transfer belt 107.

Figure 2:
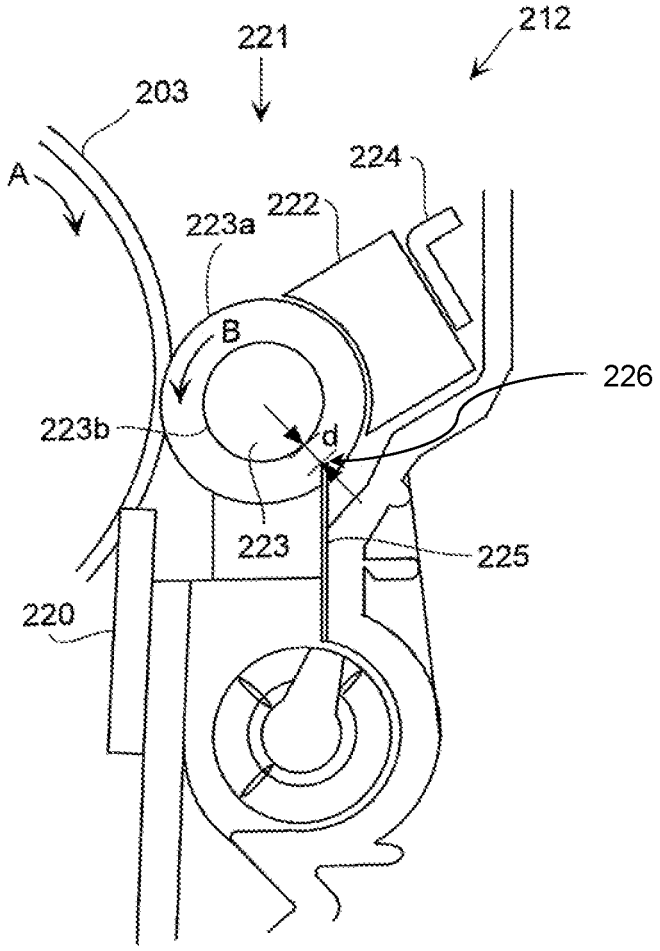
FIG. 2 is an enlarged view of a portion of FIG. 1, showing a cleaning device of the example imaging apparatus.

FIG. 2 is a schematic diagram showing an enlarged portion of the example imaging apparatus 101, illustrating an example cleaning device 212. The example cleaning device 212 has a cleaning blade 220 for scraping residues on a surface of a rotating photosensitive body 203 by abutting the surface; and a lubricant application device 221. The lubricant application device 221 may include: a lubricant supply source 222; an application roller 223; a support member 224 and an application bristle restoration member 225. The application roller 223 may have application bristles 223*a* radially arranged at an outer circumferential surface thereof. The application bristles 223*a* may scrape a lubricant from the lubricant supply source 222 and apply the lubricant to the photosensitive body 203. The support member 224 may support the lubricant supply source 222 and urge the lubricant supply source 222 toward the application bristles 223*a* with a constant force. The application bristle restoration member 225 may recover the application bristles 223*a* from a bristle-bending tendency, wherein the application bristles 223*a* or a portion of the application bristles 223*a* are deformed (e.g. even without any external bias) relative to an initial state. For example, in the initial state, the application bristles 223*a* have a tendency to align with a radial direction that extends radially from a center axis of rotation of the application roller 223. When the application bristles 223*a* are imparted with a bristle-bending tendency, the application bristles 223*a* may deviate from the radial direction, even without any external bias.

The cleaning blade 220 may be formed of an elastic body such as urethane rubber. Residues on the photosensitive body 203, which are to be removed by the cleaning blade 220, may include toner, carrier and/or nitrogen oxides generated at the time of charging the photosensitive body 203 by the charging roller 104.

The lubricant supply source 222 may include a molded body formed in a predetermined shape (a bar, a rectangular column, a circular column or the like) of a lubricant. The lubricant supply source 222 may be a molded body of, for example, a fatty acid metal salt. The lubricant supply source 222 may also be adapted so as to contain a certain amount of an inorganic lubricant or silicone resin relative to the fatty acid metal salt, for example, with the purpose of enhancing the lubricating capacity of the surface of the photosensitive body 203. The formed lubricant supply source 222 may be used, for example, by connecting to the support member 224 by means of an adhesive or the like. The support member 224 may be formed of a metal (iron, aluminum, stainless, etc.), an alloy, a resin or the like.

The application roller 223 may be supported within the imaging apparatus 101 in a rotatable manner. The application bristles 223*a* disposed on the outer circumferential surface of the application roller 223 may abut the photosensitive body 203 over the entire length thereof along the axial direction of the photosensitive body 203. The application roller 223 may be formed of, for example, a resin (epoxy resin, phenol resin, etc.), or a metal (iron, aluminum, stainless, etc.). The application roller 223 may have a cylindrical shape (for example, a shape of a circular column or a cylindrical shape).

The application bristle restoration member 225 may include a plate member having a long side 226, e.g. a lengthwise side having a length at least equal to the entire length of the application roller 223 along the axial direction of the application roller 223. The application bristle restoration member 225 may be spaced apart from the application roller 223 by a distance that is shorter than the length of the application bristles 223*a*. For example, the long side 226 is disposed at a position separated from an outer circumferential surface 223*b* of the application roller 223 by a predetermined distance d shorter than the entire length of the application bristles 223*a* along the radial direction of the application roller 223. Accordingly, the application bristles 223*a* may contact the long side 226 of the application bristle restoration member 225. The application bristle restoration member 225 may be formed of, for example, a metal (iron, aluminum, stainless, etc.), a resin, or the like.

The application roller 223 and the photosensitive body 203 may rotate during an imaging operation and over predetermined time periods before and after the imaging operation, During the rotation, the application bristles 223*a* of the application roller 223 may scrape a lubricant from the lubricant supply source 222 and apply the lubricant to the entire surface of the photosensitive body 203. During this process, the photosensitive body 203 may rotate clockwise (indicated by Arrow A) and the application roller 223 may rotate counterclockwise (indicated by Arrow B) (hereinafter, also referred to as normal rotation).

Figure 3:
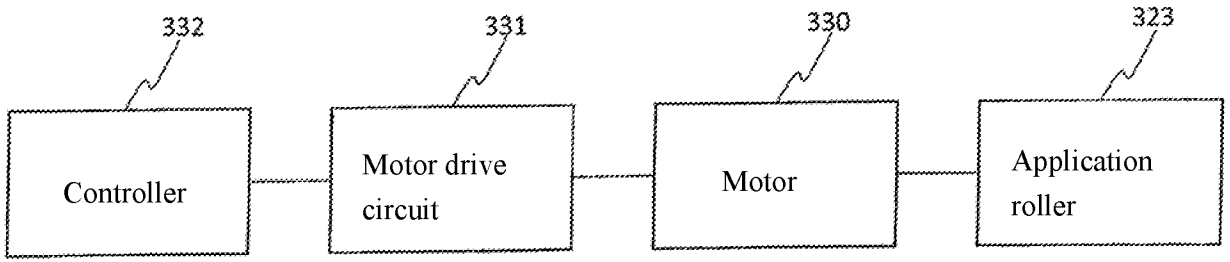
FIG. 3 is a block diagram showing an example hardware configuration of an example lubricant application device.

With reference to FIG. 3, the lubricant application device 221 may have a hardware configuration including a motor 330 for rotating an application roller 323, a motor drive circuit 331 for driving the motor, and a controller 332 for controlling the motor drive circuit 331. The controller 332 may be a controller dedicated to the motor drive circuit 331, or the control may be implemented by a main controller of an imaging apparatus (e.g. example imaging apparatus 101 in FIG. 1).

Figure 4A:
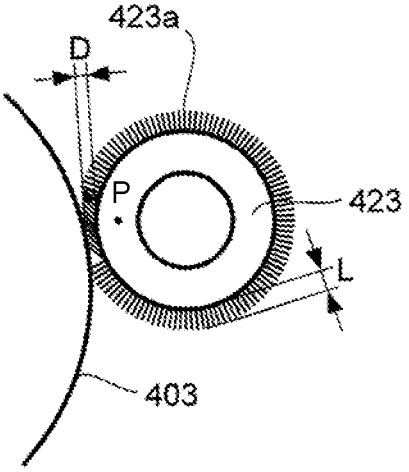
FIG. 4A is a schematic diagram showing an operational state of an example lubricant application device.
Figure 4B:
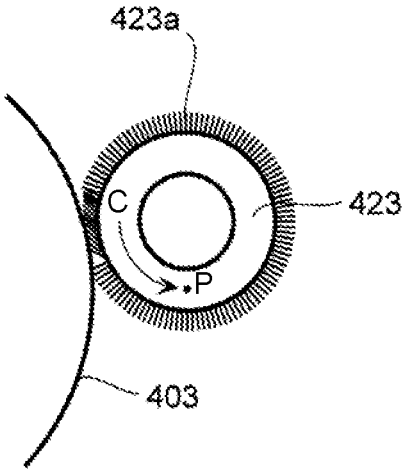
FIG. 4B is schematic diagram showing another operational state of the example lubricant application device shown in FIG. 4A.

FIGS. 4A and 4B show an operation of an example lubricant application device (e.g. lubricant application device 221), wherein application bristles 423*a* rotate periodically to prevent a bristle-bending tendency thereof. An application roller 423 may be positioned so that a minimum distance D between the outer circumferential surface of the application roller 423 and a photosensitive body 403 is shorter than the entire length L of the application bristle 423*a* (the same applies to FIGS. 5A to 5C, 6A to 6C, 7A to 7C, and 8A to 8D). In addition, a position marker P (or dot) on the application roller 423 indicates the same position on the application roller 423, and an arrow C on the application roller 423 indicates that the application roller 423 rotates from a starting point of the arrow C to an end point thereof (the same applies to FIGS. 5A to 5C, 6A to 6C, and 8A to 8D). With reference to FIGS. 4A and 4B, a controller (e.g. controller 332 in FIG. 3) may control a drive unit (e.g. motor drive circuit 331, as well as the motor 330 in FIG. 3) to repeatedly rotate the application roller 423 at predetermined time intervals during which no bristle-bending tendency is developed due to the abutment between the application bristles 423*a* and the photosensitive body 403 (that is, before a bristle-bending tendency is developed in the application bristles 423*a*).

With reference to FIG. 4A, bristles may be bent in an abutment portion between the photosensitive body 403 and the application bristles 423*a*, but they may be in a state where a bristle-bending tendency has not yet occurred (e.g. an initial state or a default state of the application bristles 423*a* where the application bristles 423*a* extend substantially radially from a center rotational axis of the application roller 423). With reference to FIG. 4B, when the application roller 423 is rotated after a predetermined time interval as described above such that it has been rotated by about 90° from the state illustrated in FIG. 4A, portions of the application bristles 423*a* which are bent in FIG. 4A may be raised, while a bristle-bending tendency has not yet occurred.

Figure 5C:
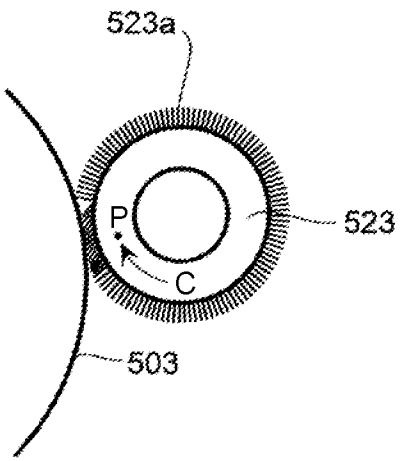
FIG. 5C is schematic diagram showing another operational state of the example lubricant application device shown in FIG. 5A.
Figure 5B:
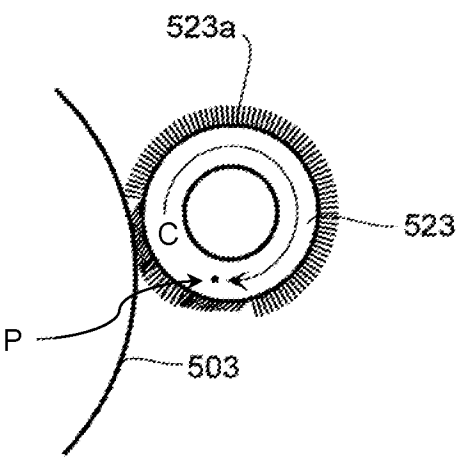
FIG. 5B is schematic diagram showing another operational state of the example lubricant application device shown in FIG. 5A.
Figure 5A:
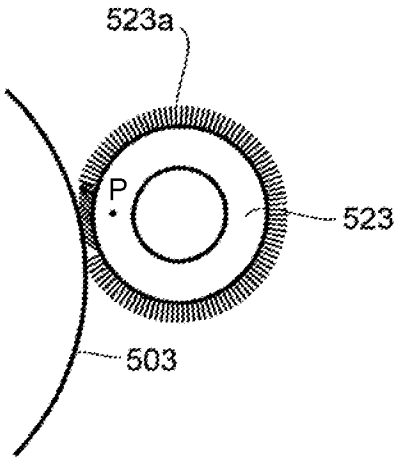
FIG. 5A is a schematic diagram showing an operational state of an example lubricant application device.

FIG. 5A to 5C are schematic diagrams illustrating an operation of another example lubricant application device (e.g. lubricant application device 221), which recovers application bristles 523*a* from a bristle-bending tendency by way of abutment or contact with a photosensitive body 503. With reference to FIG. 5A to 5C, a controller (e.g. controller 332 in FIG. 3) may control a drive unit (e.g. motor drive circuit 331 and the motor 330 in FIG. 3) to reverse-rotate an application roller 523 at least by 360° before an imaging operation.

FIG. 5A shows an example state in which portions of the application bristles 523*a* abutting the photosensitive body 503 have had a bristle-bending tendency, for example, in the case that an imaging apparatus (e.g. imaging apparatus 101) is turned off and a certain period (e.g. 3 days) has passed since the latest imaging operation. In the bristle-bending tendency, a portion of the application bristles (e.g. 523*a*) of an application roller (e.g. 523) may have been deformed to deviate from a radial direction that extends radially from a center rotational axis of the application roller, wherein the radial direction is associated with an initial state of the application bristles.

FIG. 5B shows a moment when (or an example state wherein) the application roller 523 has been reverse-rotated by about 270° relative to the state of FIG. 5A, before an imaging operation. The portions of the application bristles 523*a* shown in FIG. 5A having the bristle-bending tendency are moved downward in FIG. 5B.

FIG. 5C shows a moment when (or an example state wherein) the application roller 523 has been reverse-rotated further by about 90° from the state of FIG. 5B. In this case, the portions of the application bristles 523*a* having a bristle-bending tendency shown in FIG. 5B are bent by abutting the photosensitive body 503 in a direction opposite to a direction before the abutment; and this process for bending the application bristles 523*a* in the opposite direction recovers the application bristles 523*a* from the bristle-bending tendency. Thus, when starting an ordinary imaging operation, for example, by rotating the application roller 523 in a forward direction from the state of FIG. 5C, a sufficient amount of lubricant may be applied uniformly to the photosensitive body 503 and the imaging operation can be performed in a state where the photosensitive body 503 is sufficiently protected. For example, the application roller 523 may apply an amount of lubricant that is sufficient to suitably protect the photosensitive body 503 during the imaging operation.

Figure 6C:
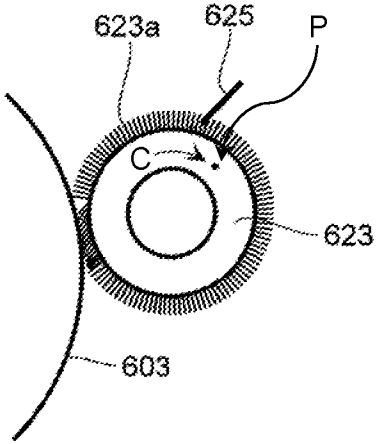
FIG. 6C is schematic diagram showing another operational state of the example lubricant application device shown in FIG. 6A.
Figure 6B:
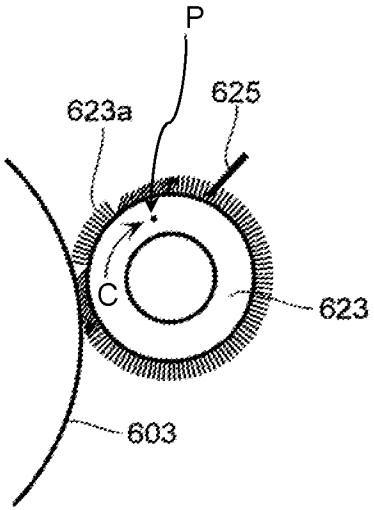
FIG. 6B is schematic diagram showing another operational state of the example lubricant application device shown in FIG. 6A.
Figure 6A:
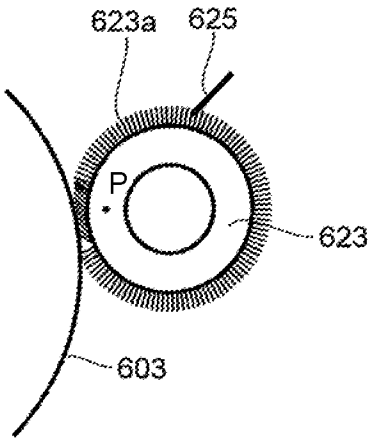
FIG. 6A is a schematic diagram showing an operational state of an example lubricant application device.

FIG. 6A to 6C are schematic diagrams showing an operation of a further example lubricant application device (e.g. lubricant application device 221), which recovers application bristles 623*a* from a bristle-bending tendency by way of an abutment or contact with an application bristle restoration member 625. With reference to FIG. 6A to 6C, a controller (e.g. controller 332 in FIG. 3) may control a drive unit (e.g. motor drive circuit 331, and the motor 330 in FIG. 3) to reverse-rotate an application roller 623 at least until portions of the application bristles 623*a* having a bristle-bending tendency contact (e.g. pass through) the application bristle restoration member 625.

In FIG. 6A, both a photosensitive body 603 and the application roller 623 are stopped from rotating, in an operational state wherein the portions of the application bristles 623*a* abutting the photosensitive body 603 have a bristle-bending tendency in the same manner as in the case of FIG. 5A.

FIG. 6B shows a moment when (or operational state wherein) the application roller 623 has been rotated by about 90°, for example, before an imaging operation. The portions of the application bristles 623*a* have a bristle-bending tendency shown in FIG. 6A are moved upward in the figure.

FIG. 6C shows a moment when (or an operational state wherein) the application roller 623 has been further reverse-rotated by about 90° from the state of FIG. 6B. The portions of the application bristles 623*a* having a bristle-bending tendency shown in FIG. 6B pass through the application bristle restoration member 625 while abutting the application bristle restoration member 625. The application bristles 623*a* are thereby brought into a state where the portions having the bristle-bending tendency are restored (e.g. an initial state of the application bristles 623*a*). The application bristle restoration member 625 may be located and arranged to contact (or stroke, or impinge on) the bent portions of the application bristles 623*a* to restore the initial state of the application bristles 623*a* where the application bristles 623*a* extend substantially radially from a center rotational axis of the application roller 623. By starting an ordinary imaging operation, for example, by rotating the application roller 623 in a forward direction from this state, it is possible to apply a sufficient amount of lubricant uniformly to the photosensitive body 603 and the imaging operation can be performed in a state where the photosensitive body 603 is sufficiently protected.

Figure 7A:
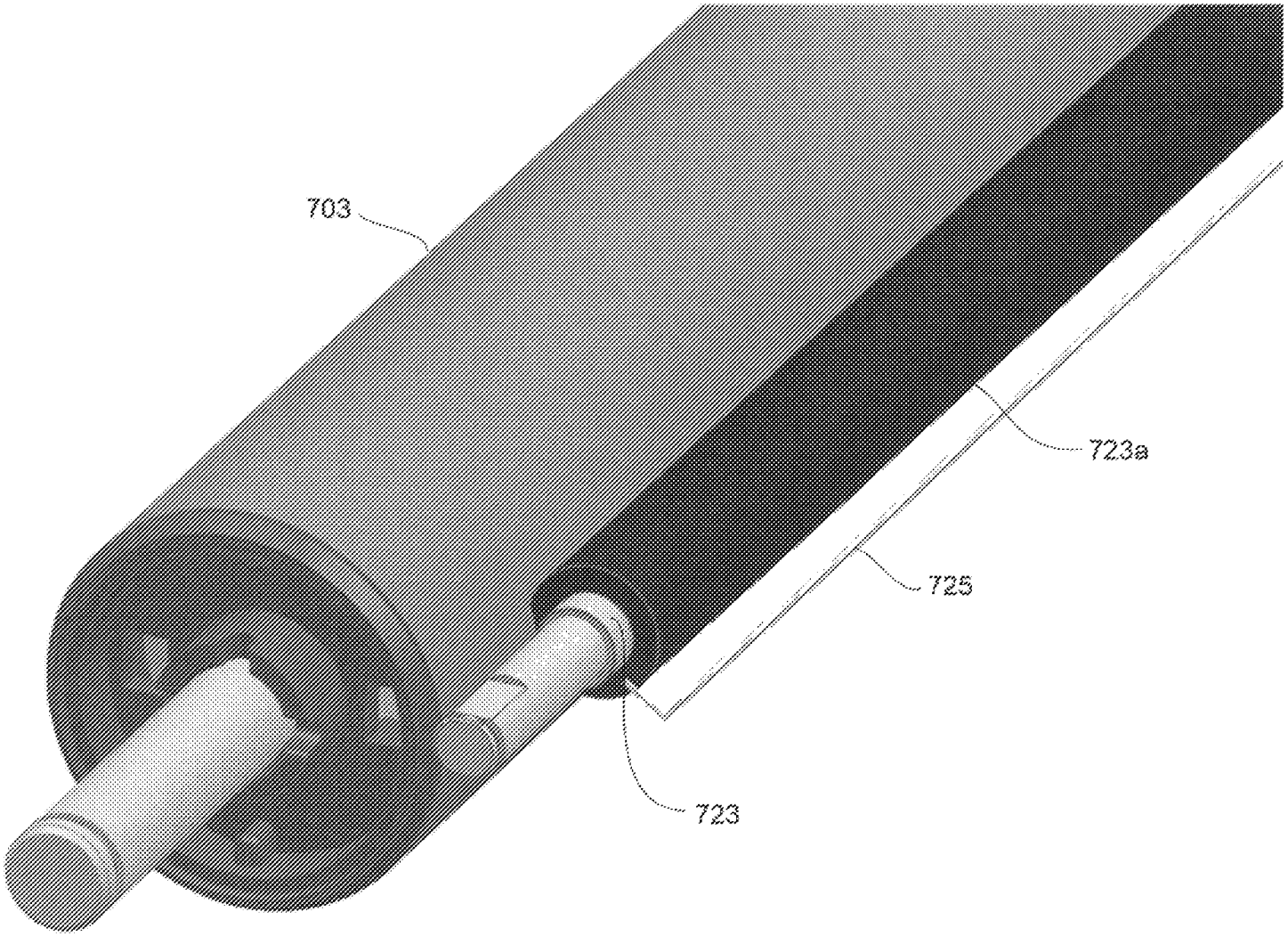
FIG. 7A is a perspective view schematically showing a portion of an example lubricant application device.
Figure 7B:
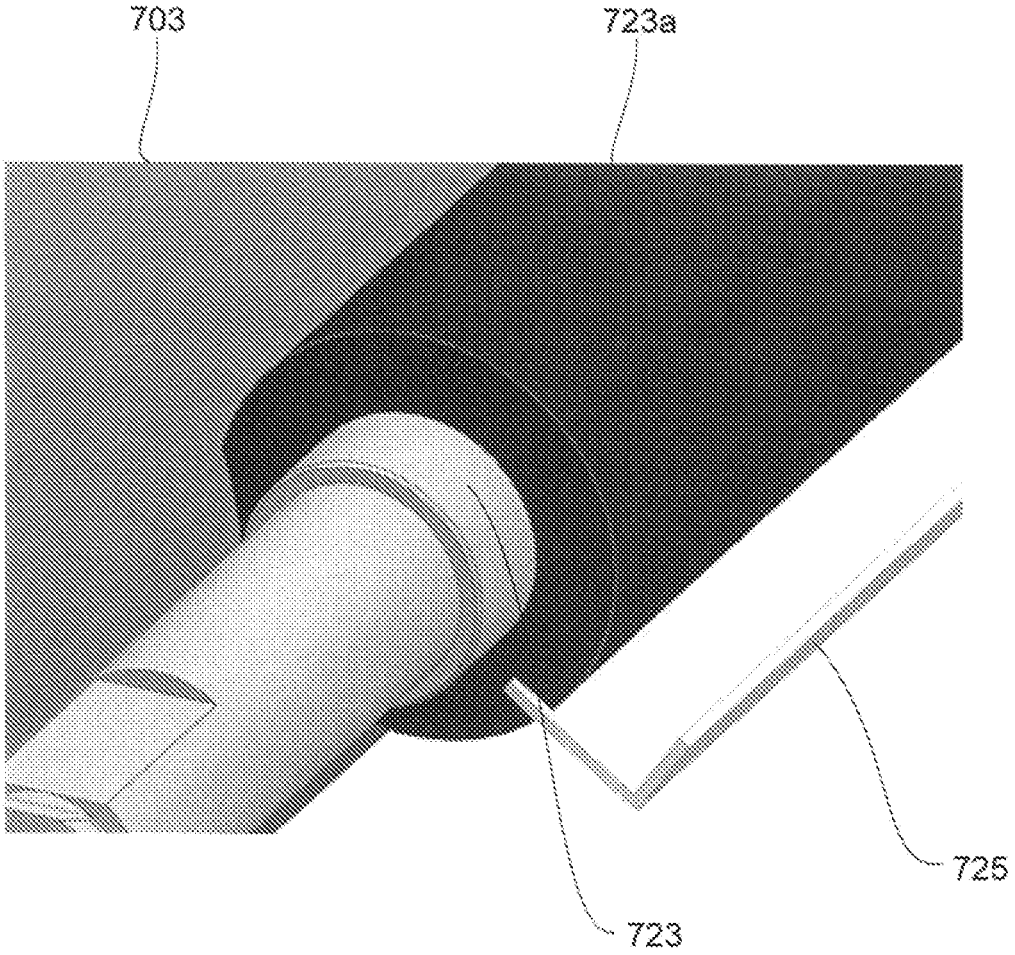
FIG. 7B is a perspective view showing an enlarged vicinity of an application roller of FIG. 7A
Figure 7C:
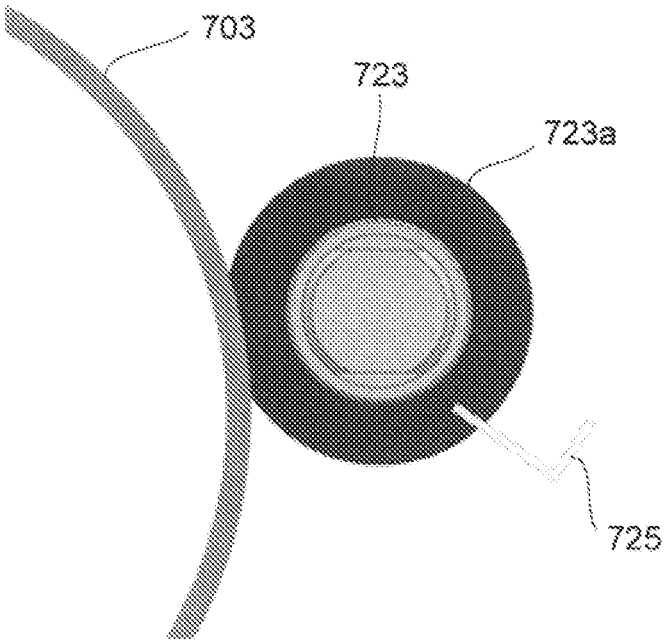
FIG. 7C is a side view of FIG. 7A.

FIG. 7A is a schematic perspective view showing a portion of another example lubricant application device (e.g. lubricant application device 221). FIG. 7B is an enlarged perspective view of a portion of the example of FIG. 7A, showing a photosensitive body 703, application bristles 723*a*, an application roller 723, and an application bristle restoration member 725. FIG. 7C is a side view of the portion illustrated in FIG. 7A.

FIG. 8A to 8D are schematic diagrams showing an operation of a further example lubricant application device (e.g. lubricant application device 221), wherein a lubricant application device (e.g. lubricant application device 221) having the configuration shown in FIGS. 7A to 7C is used to recover application bristles 823*a* from a bristle-bending tendency, by way of abutment between the application bristles 823*a*; and a photosensitive body 803 and an application bristle restoration member 825. With reference to FIG. 8A to 8D, a controller (e.g. controller 332 in FIG. 3) may control a drive unit (e.g. motor drive circuit 331, and the motor 330 in FIG. 3) to invert a bristle-bending direction of the portions of the application bristles 823*a* abutting the photosensitive body 803 after an imaging operation.

Figures 8A, 8B, 8C, 8D:
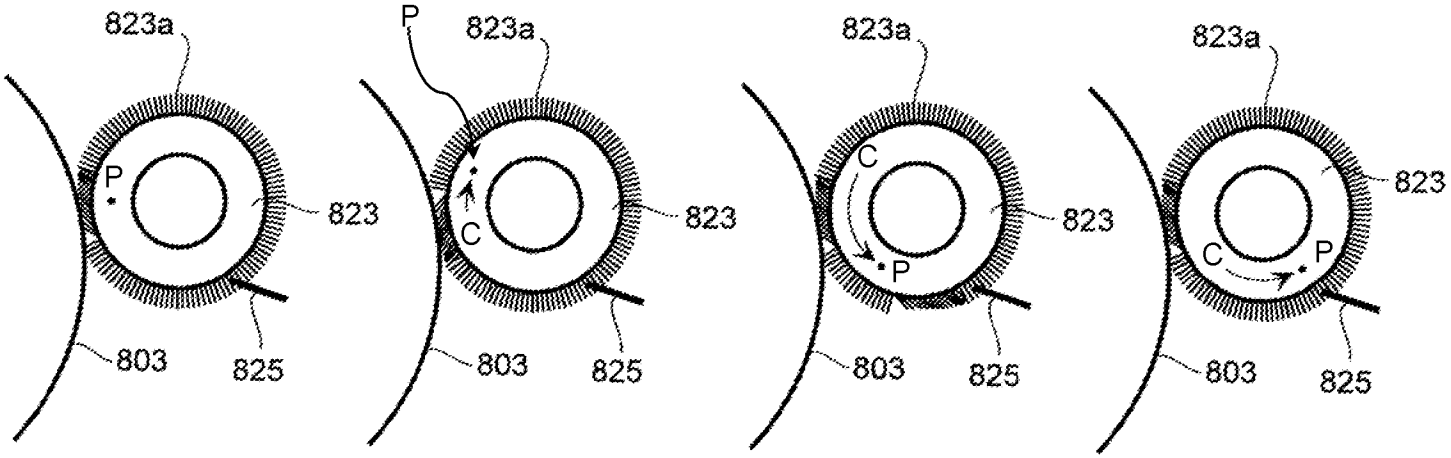
FIG. 8A is a schematic diagram showing an operational state of an example lubricant application device.
FIG. 8B is schematic diagram showing another operational state of the example lubricant application device shown in FIG. 8A.
FIG. 8C is schematic diagram showing another operational state of the example lubricant application device shown in FIG. 8A.
FIG. 8D is schematic diagram showing another operational state of the example lubricant application device shown in FIG. 8A.

FIG. 8A shows a state wherein the photosensitive body 803 and an application roller 823 are stopped right after an imaging operation. In this case, since this state is right after the imaging operation, the portions of the application bristles 823*a* abutting the photosensitive body 803 have no bristle-bending tendency. For example, application bristles 823*a* are free of any bristle-bending tendency, in that the portions of the application bristles 823*a* abutting the photosensitive body 803 are only temporarily deformed and naturally return to their initial state when moved away from the photosensitive body 803, where in the initial state, the application bristles 823*a* extend substantially radially from a center rotational axis of the application roller 823.

FIG. 8B shows a state where the application roller 823 has been reverse-rotated until the bristle-bending direction of the portions of the application bristles 823*a* abutting the photosensitive body 803 are oriented opposite to the bristle-bending direction show in FIG. 8A. For example, in the case that an imaging operation is not performed from this time on (e.g. an imaging apparatus, e.g. imaging apparatus 101, is turned off) and a certain period (e.g. 3 days) has passed, the application bristles 823*a* may as a result acquire a bristle-bending tendency in the state shown in FIG. 8B.

FIG. 8C shows a moment when (or operational state wherein) the application roller 823 has been rotated in a forward direction by about 90° from the state of FIG. 8B, for example, during a succeeding imaging operation (or during a subsequent imaging operation), and wherein at least a portion of the application bristles 823*a* have been imparted with a bristle-bending tendency. In some examples, the application bristles 823*a* have been imparted with a bristle-bending tendency when the application bristles 823*a* have been subjected to a deformation by which the deformed application bristles 823*a*, deviate from a radial direction that extends radially from a center rotational axis of the application roller 823.

FIG. 8D shows a moment when (or an operational state wherein) the application roller 823 has been rotated in a forward direction further by about 90° from the state of FIG. 8C, and wherein the portions of the application bristles 823*a* having a bristle-bending tendency pass through (or contact) the application bristle restoration member 825 while abutting with it, and are restored thereby. For example, the application bristle restoration member 825 impinges on (or strokes) the application bristles 823*a* as they are rotated about the application roller 823, to restore the orientation of the application bristles 823*a* back to their initial state, where the application bristles 823*a* are substantially aligned with the radial direction from the center rotational axis of the application roller 823. Thus, a sufficient amount of lubricant can be subsequently applied uniformly to the photosensitive body 803, and the imaging operation can be performed in a state where the photosensitive body 803 is sufficiently protected. Further, the restoration operation for the application bristles 823*a* may be performed as part of the imaging operation, thus substantially eliminating any wait time for the restoration of the application bristles 823*a* and permitting a more rapid start of imaging or image formation operation.

In the control of operations of the example lubricant application device (e.g. lubricant application device 221), with reference to FIGS. 4A to 8D, the control of the rotation of a photosensitive body (e.g. photosensitive body 803) may include controlling the photosensitive body (e.g. photosensitive body 803) to be stopped or rotated. The examples described herein with reference to FIGS. 4A to 8D may be modified in terms of the bristle-bending direction of the application bristles (e.g. application bristles 823*a*) in an initial state (e.g. state of FIG. 8A), the location of the application bristle restoration member (e.g. application bristle restoration member 825), and the rotation direction of the photosensitive body (e.g. photosensitive body 803) and the application roller (e.g. application roller 823), to obtain similar results as in the above-described examples.

Further, in the case that an example lubricant application device (e.g. lubricant application device 221) among the examples described with reference to FIGS. 4A to 8D, applies a lubricant to a photosensitive body (e.g. photosensitive body 803), the photosensitive body and the application roller (e.g. application roller 823) may both rotate while the application roller rotates in a forward direction relative to the photosensitive body, and the moving speed of the application bristles (e.g. application bristles 823*a*) of the application roller may be about 0.5 to 1.5 times that of the photosensitive body. In that case, a sufficient amount of lubricant can be uniformly applied to the surface of the photosensitive body, to suitably protect the photosensitive body.

Figure 9:
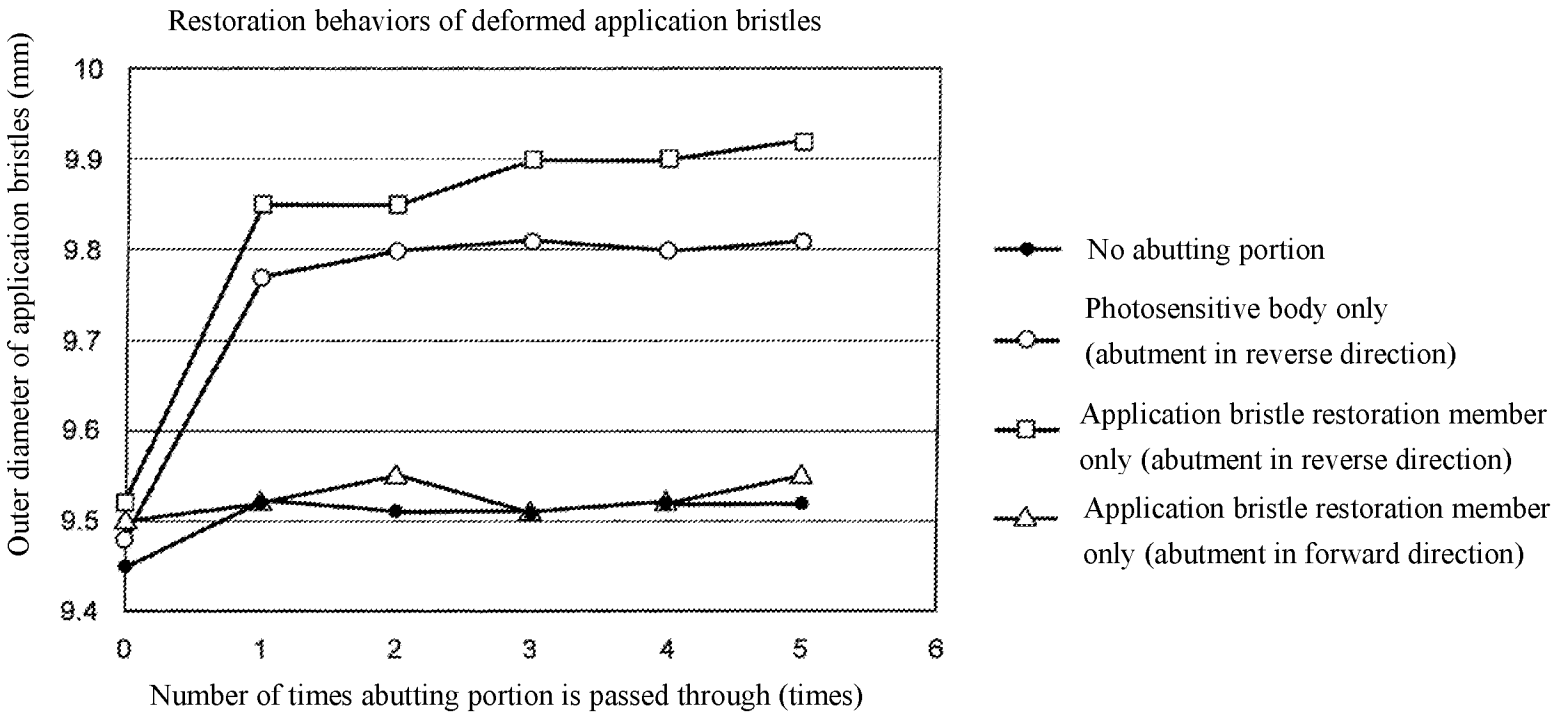
FIG. 9 is a graph showing restoration behaviors of deformed application bristles.

FIG. 9 is a graph showing restoration behaviors of application bristles (e.g. application bristles 823*a*) having portions with a 0.5-mm radius reduction caused by a bristle-bending tendency. The horizontal axis indicates a number of times when the portions of the application bristles having a bristle-bending tendency contact (e.g. abut with and pass through) an abutting portion (e.g. photosensitive body 803, the application bristle restoration member 825) and pass therethrough in order to recover the application bristles from a bristle-bending tendency. The vertical axis indicates an outer diameter of the portion of the application bristles having the bristle-bending tendency after the application bristles have contacted (or passed through) the abutting portion for the number of times the abutting portion is contacted (or passed through) indicated by the horizontal axis.

In the graph of FIG. 9, plots indicate restoration behaviors based on outer diameters of the application roller, at portions having a bristle-bending tendency in the application bristles. Solid circles (●) represent a case in which the application bristles do not pass through or contact any abutting portion (e.g. the application bristles are rotated). Hollow triangles (Δ) represent a case where the application bristles pass through or contact an application bristle restoration member (e.g. application bristle restoration member 825) while abutting the application bristle restoration member in a forward direction (i.e. direction smoothing down the portions of the application bristles having a bristle-bending tendency). Hollow circles (○) represent a case where the application bristles pass through or contact a photosensitive body (e.g. photosensitive body 803) while abutting the photosensitive body in a reverse direction (i.e. direction going against the grain of the portions of the application bristles having a bristle-bending tendency). Hollow squares (□) represent a case where the application bristles pass through the application bristle restoration member while abutting the application bristle restoration member in a reverse direction (i.e. direction going against the grain of the portions of the application bristles having the bristle-bending tendency).

Based on the graph of FIG. 9, the cases in which the application bristles abut the application bristle restoration member in a reverse direction is the most effective for restoring the bristles, and the next most effective, is the case where the application bristles abut the photosensitive body in a reverse direction. It is understood that both cases can provide a sufficient restoration effect through one-time abutment.

Also, an example lubricant application device exhibits maximum or prominent effects in the prevention of a bristle-bending tendency of an application bristles (e.g. application bristles 823*a*) and the recovery therefrom under the following conditions.

The above-mentioned graph shows measurement results under the following conditions.

Material of the application bristles: polyethylene terephthalate.

Entire length of the application bristles: 1 to 2 mm.

Fiber diameter of the application bristles: 3 to 10 deniers.

Fiber density of the application bristles: 78 to 465 per $mm^2$ (or 50 to 300 $KF/inch^2$).

Amount of intrusion of the application bristles to the photosensitive body (e.g. photosensitive body 803): 0.3 to 1.3 mm. The amount of intrusion may be obtained by subtracting the minimum distance (e.g. D in FIG. 4) between the outer circumferential surface (e.g. outer circumferential surface 223*b*) of the application roller (e.g. application roller 823) and the photosensitive body from the entire length (e.g. L in FIG. 4) of the application bristles.

Amount of intrusion of the application bristle restoration member (e.g. application bristle restoration member 825) to the application bristles: 0.3 to 1.3 mm. The amount of intrusion may be obtained by subtracting, from the entire length of the application bristles, a distance (e.g. d in FIG. 2) from the outer circumferential surface of the application roller to the long side (e.g. lengthwise side 226) of the application bristle restoration member along the radial direction of the application roller.

As described above, examples of the lubricant application device prevent a bristle-bending tendency of application bristles, caused by abutment between an application roller and a photosensitive body, or recover a bristle-bending tendency of application bristles, caused by the abutment. This enables a sufficient amount of lubricant to be applied uniformly to the photosensitive body. As a result, for example, at the time of charging a photosensitive body by a charging roller, a discharge stress imposed on the photosensitive body can be reduced. Also, a friction between a photosensitive body and a cleaning blade abutting the photosensitive body is decreased, and abrasion of the photosensitive body and the cleaning blade is lightened, thereby enabling the extension of their service lives. Further, it is possible to obviate problems such as the generation of chatter (i.e. micro vibration) or squeal (i.e. unusual noise) of the cleaning blade and curls (also called as flips) of the cleaning blade caused by an excessive friction with the photosensitive body.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. A lubricant application device comprising:

an application roller having an outer circumferential surface and application bristles radially arranged about the outer circumferential surface to receive lubricant from a lubricant supply source and to apply the lubricant to a photosensitive body in an imaging apparatus, wherein the application roller is positioned relative to the photosensitive body such that a minimum distance between the outer circumferential surface of the application roller and the photosensitive body is shorter than a length of the application bristles;

a drive unit to rotate the application roller; and a controller to control the drive unit to rotate the application roller to counteract a bristle-bending tendency of the application bristles of the application roller caused by an abutment between the application bristles and the photosensitive body by repeatedly rotating the application roller at predetermined time intervals during which no bristle-bending tendency of the application bristles is developed.

2. The lubricant application device according to claim 1, wherein the controller is to control the drive unit to, before an imaging operation, rotate the application roller at least by 360° in a rotational direction by which portions of the application bristles of the application roller having a bristle-bending tendency are restored by the abutment between the application bristles and the photosensitive body.

3. The lubricant application device according to claim 1, comprising:

a plate-shaped application bristle restoration member having a long side that has a length at least equal to a length of the application roller along an axial direction of the application roller, wherein the long side of the plate-shaped application bristle restoration member is disposed at a position separated from the outer circumferential surface of the application roller by a predetermined distance shorter than the length of the application bristles along a radial direction of the application roller, wherein the controller is to control the drive unit to, before an imaging operation, rotate the application roller such that portions of the application bristles of the application roller having a bristle-bending tendency contact the plate-shaped application bristle restoration member at least once, the application roller to rotate in a direction by which the portions of the application bristles having the bristle-bending tendency are restored by contacting the plate-shaped application bristle restoration member.

4. The lubricant application device according to claim 3, wherein:

the application bristles of the application roller comprise polyethylene terephthalate;

the length of the application bristles is of 1 to 2 mm, and the application bristles have a fiber diameter of 3 to 10 deniers and a fiber density of 78 to 465 per $mm^2$;

an amount of intrusion of the application bristles is 0.3 to 1.3 mm, wherein the amount of intrusion of the application bristles is obtained by subtracting a minimum distance between the outer circumferential surface of the application roller and the photosensitive body from the length of the application bristles; and an amount of intrusion of the plate-shaped application bristle restoration member is 0.3 to 1.3 mm, wherein the amount of intrusion of the plate-shaped application bristle restoration member is obtained by subtracting, from the length of the application bristles, a distance from the outer circumferential surface of the application roller to the long side of the application bristle restoration member along the radial direction of the application roller.

5. The lubricant application device according to claim 1, comprising:

a plate-shaped application bristle restoration member having a long side that has a length at least equal to a length of the application roller along an axial direction of the application roller, wherein the long side of the plate-shaped application bristle restoration member is disposed at a position separated from the outer circumferential surface of the application roller by a predetermined distance shorter than the length of the application bristles along a radial direction of the application roller, the plate-shaped application bristle restoration member to restore, at a time of a forward rotation of the application roller, portions of the application bristles bent in a first direction, wherein the controller is to control the drive unit to:

stop rotating the application roller after an imaging operation, wherein portions of the application bristles of the application roller abutting the photosensitive body are bent in a second direction opposite to the first direction;

reverse-rotate the application roller until the portions of the application bristles abutting the photosensitive body are bent in the first direction; and restore the portions of the application bristles of the application roller having a bristle-bending tendency in the first direction through the plate-shaped application bristle restoration member during a succeeding imaging operation.

6. The lubricant application device according to claim 1, wherein, when applying the lubricant to the photosensitive body, the photosensitive body is to rotate, and the application roller is to rotate in a forward direction relative to the photosensitive body wherein a moving speed of the application bristles of the application roller is 0.5 to 1.5 times a moving speed of the photosensitive body.

7. The lubricant application device according to claim 1, comprising the lubricant supply source, wherein the lubricant supply source is formed of a molded body of a fatty acid metal salt.

8. A lubricant application device comprising:

an application roller located adjacent a photosensitive body of an imaging apparatus, the application roller having an outer circumferential surface and application bristles radially arranged about the outer circumferential surface, the application bristles to transfer lubricant from a lubricant supply source to the photosensitive body, wherein a minimum distance between the outer circumferential surface of the application roller and the photosensitive body is shorter than a length of the application bristles, causing the application bristles between the circumferential surface of the application roller and the photosensitive body to bend;

a drive unit to rotate the application roller; and a controller to control the drive unit to:

rotate the application roller in a rotational direction that counteracts a bristle-bending tendency of the application bristles having been bent, and before an imaging operation, rotate the application roller at least by 360° in the rotational direction by which portions of the application bristles of the application roller having the bristle-bending tendency are restored by an abutment between the application bristles and the photosensitive body.

9. The lubricant application device according to claim 8, wherein the bristle-bending tendency deforms the application bristles to deviate from an initial state, wherein in the initial state, the application bristles tend to extend substantially radially from the outer circumferential surface of the application roller, and wherein counteracting the bristle-bending tendency of the application bristles comprises at least one of preventing the application bristles of the application roller from being imparted with the bristle-bending tendency, or recovering the initial state of the application bristles having the bristle-bending tendency.

10. A method comprising:

rotating an application roller having application bristles to apply lubricant to a photosensitive body in an imaging apparatus, wherein an abutment of the application bristles against the photosensitive body bends the application bristles; and controlling a rotation of the application roller to counteract a bristle-bending tendency of the application bristles having been bent by repeatedly rotating the application roller at predetermined time intervals during which no bristle-bending tendency is developed due to the abutment between the application bristles of the application roller and the photosensitive body.

11. The method according to claim 10, wherein at least a portion of the application bristles of the application roller having a bristle-bending tendency are bent toward a first rotational direction, and wherein the controlling of the rotation of the application roller comprises: before an imaging operation, rotating the application roller at least by 360° in a second rotational direction that is opposite to the first rotational direction to restore the portions of the application bristles of the application roller having the bristle-bending tendency by rotationally engaging the photosensitive body.

12. The method according to claim 10, wherein an application bristle restoration member is located adjacent the application roller to impinge the application bristles of the application roller being rotated, wherein portions of the application bristles having been imparted with the bristle-bending tendency extend toward a first rotational direction, and wherein the controlling of the rotation of the application roller, comprises: rotating the application roller in the first rotational direction to restore the portions of the application bristles of the application roller having the bristle-bending tendency by rotationally engaging the application bristle restoration member at least once before an imaging operation.

13. The method according to claim 10, wherein an application bristles restoration member is located adjacent the application roller to impinge the application bristles when the application roller is rotated, in order to restore, at a time of a forward rotation of the application roller, portions of the application bristles bent toward a first direction, wherein controlling a rotation of the application roller, comprises:

stopping the application roller from rotating after an imaging operation, whereby portions of the application bristles of the application roller abutting the photosensitive body are bent toward a second direction opposite to the first direction; and reverse-rotating the application roller until the portions of the application bristles abutting the photosensitive body are bent toward the first direction, and wherein the portions of the application bristles of the application roller bristle-bending tendency toward the first direction are restored via the application bristle restoration member during a succeeding imaging operation.

* * * * *